US005775034A

United States Patent [19]

Logue

[11] Patent Number: 5,775,034

[45] Date of Patent: Jul. 7, 1998

[54] FOLDING SCREEN ENVIRONMENT SYSTEM

[76] Inventor: Michael F. D. Logue, 4221 Army St., Apt. 1, San Francisco, Calif. 94131

[21] Appl. No.: 659,715

[22] Filed: Jun. 10, 1996

[51] Int. Cl.[6] ..... A47F 10/00; A47B 87/00

[52] U.S. Cl. ..... 52/36.1; 32/36.4; 32/71; 32/239; 108/37; 108/48; 160/135; 312/242; 312/314

[58] Field of Search ..... 52/36.1, 36.2, 52/36.4, 36.5, 71, 220.7, 239; 160/135; 108/48, 37; 312/313, 314, 242, 241; 292/145, 146, DIG. 15

[56] References Cited

U.S. PATENT DOCUMENTS

| | | | |
|---|---|---|---|
| 1,237,030 | 8/1917 | Haas | 292/DIG. 15 X |
| 1,534,902 | 4/1925 | Borne | 292/DIG. 15 X |
| 3,042,978 | 7/1962 | Eames et al. | 108/48 X |
| 3,088,127 | 5/1963 | Eames | 108/48 X |
| 3,748,010 | 7/1973 | Garte | 108/48 X |
| 3,916,972 | 11/1975 | Breiner | 160/135 |
| 4,155,609 | 5/1979 | Skafte et al. | 108/48 X |
| 4,874,027 | 10/1989 | Boundy et al. | 52/239 X |
| 5,172,530 | 12/1992 | Fishel et al. | 160/135 X |
| 5,429,432 | 7/1995 | Johnson | 312/313 X |
| 5,450,694 | 9/1995 | Goranson et al. | 52/71 |
| 5,513,574 | 5/1996 | Collins | 108/48 X |

FOREIGN PATENT DOCUMENTS

| | | | |
|---|---|---|---|
| 2313882 | 2/1974 | Germany | 52/36.1 |
| 3017333 | 1/1991 | Japan | 52/36.1 |
| 3194042 | 8/1991 | Japan | 52/36.2 |

*Primary Examiner*—Carl D. Friedman
*Assistant Examiner*—Winnie S. Yip
*Attorney, Agent, or Firm*—Flehr Hohbach Test Albritton & Herbert

[57] ABSTRACT

The disclosed apparatus and system provides for two or more interacting screens that have elements such as shelves, tables, desks, lamps, lights, beds, sinks, ranges or drawers stored within the appropriate screen, when not in use, and in most instances suspended from the appropriate screen or screens, when in use. The screens and most of the elements interrelate when in a fully set up configuration. The screens with elements in the stored configuration may be moved against a wall, into a space in the wall or into a closet. The screens with elements in a set up configuration are stabilized by interacting hinges, locks and stabilization legs. The screens are also interconnected with conduits to permit utility, electrical, water and communications connections to be available at the appropriate screen. The system provides a quickly and easily set up and stored environment for use as a work, play, privacy or sleep area. Some of the elements are designed to be free standing when in use.

8 Claims, 21 Drawing Sheets

3
3
19

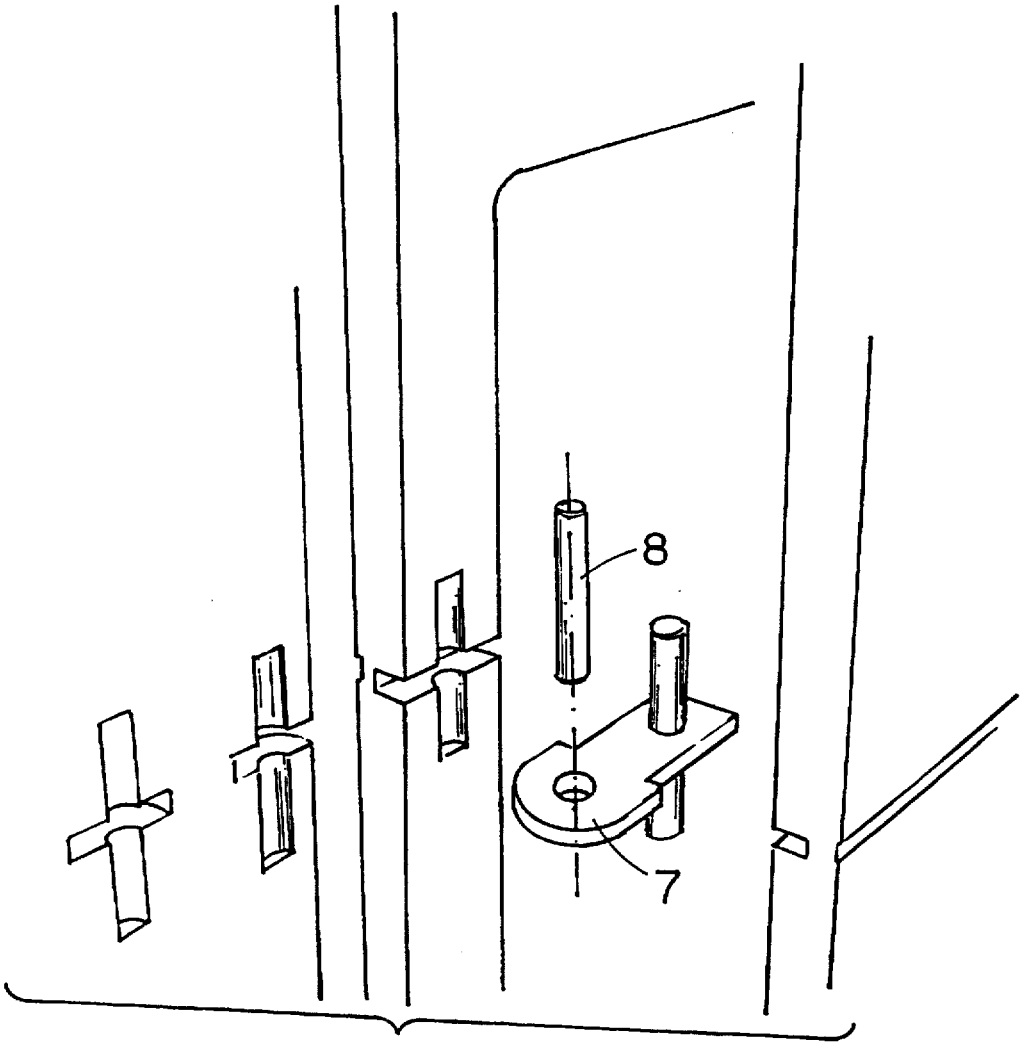
FIG. 8
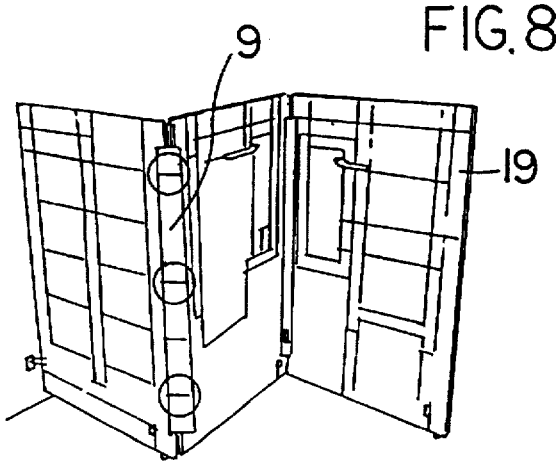

16

19
16

FOLDING SCREEN ENVIRONMENT SYSTEM

BACKGROUND OF THE INVENTION

1. Field of the Invention

My invention relates to the area of office and home space management. For many years man has struggled with the problem of having adequate space to perform all the required activities at both the workplace and at home. In some instances the solution has been to expand the area involved in order to separately accommodate all the desired activities. This approach is expensive and inefficient as some of the activities are not performed on a daily basis. This is true at both the workplace and at home. In the home compromises can be reached in order that a room becomes a multiple purpose area such as a den that provides a family TV, entertainment center, sewing, craft area and part-time home office. At the traditional workplace flexibility has not been encouraged until recently. Now more and more companies are looking to maximize the use of valuable and expensive workspace to have more than one employee use the same space. This economy of space may be accomplished by merely having several employees who work at the workplace at different times share equipment such as desks, chairs, lamps and computers. In the more aggressive approach employers have found that more than one employee can make use of the same space at different times with slight modifications in the configuration of the fixtures and equipment that are available.

2. Description of Related Art

One approach that provides limited flexibility is claimed by Schreiner U.S. Pat No. 5,394,658, however Schrciner does not provide the flexibility that industry is now requesting. Once the partitions as shown in Schreiner arc set up they are almost permanent. The user does not have the ability to alter the environment without major alterations to the set up.

My invention provides for flexibility in order that a configuration may be quickly and easily set up, altered or stored.

For sufficient stability of the screens, especially when being used as a work station with, for example, a computer keyboard, as illustrated in FIG. 14 and in general for most purposes, at least one vertical edge of the panel of one of the screens is affixed to a vertical support such as a wall. This is shown by the connection 21 in FIGS. 2, 12, 16, 17 and 20. All of the screens, as shown in FIG. 20 include rollers and some type of brake. The functional elements such as the desks, tables, and shelves, when stored, of course, become a part of the appropriate screen. And as illustrated in FIG. 1 and the sequence illustrated in FIG. 17, when the functional elements are in a stored position, they form a substantially planar surface to allow the screens to be folded against each other.

SUMMARY OF THE INVENTION

The apparatus and system disclosed in detail below is of a form that is both practical and economical in order to promote wide use. In addition to its preferred form for office and workplace use, it may be adapted for home or recreational applications.

The apparatus and system comprises of a plurality of interacting screens that provide storage space for various elements such as shelves, tables, desks, lamps, lights, drawers, sinks or ranges when in a stored configuration. Some of the elements are free standing when in a fully set up configuration. Most of the elements are partially suspended from one or more screen when in a fully set up configuration. The elements that are partially suspended from one or more of the screens interrelate with the screen, or screens, to form stable work areas. The screens interrelate with interacting hinges and locks and stabilization legs to provide further stability. Conduits are provided that interconnect the screens in order that utility, electrical, water and communication connections can be available at the desired location on the screens for use at the various work areas. The conduits also provide utility, electrical, water and communication connections between screens in order that the number of screens in a particular configuration is flexible. If desired a screen may be removed to alter the configuration, the remaining screens are connected by use of the connections in the conduit. The screen's elements are foldable and collapsible in order that they may be easily and quickly stored within or on the appropriate screen. With all elements in a stored configuration the interacting locks and stabilization legs are released, the screens are moved to a wall, placed within a space in the wall or a closet. It is also possible to store one or more of the screens while still making full use of the remaining screens in either a fully or partially set up configuration. The interconnecting conduits allow for folding of the screens as required without damage being caused to the utility, electrical, water or communication lines that are within the conduit. The screens are configured with a low center of gravity, base support and rollers for ease and stability when being moved.

While the invention will be described in connection with a preferred embodiment, it will be understood that I do not intend to limit the invention to that embodiment. On the contrary, I intent to cover all alternatives, modifications as equivalent as may be included within the spirit and scope of this invention as defined by the appended claims.

BRIEF DESCRIPTION OF THE DRAWINGS

The object and features of the invention may be understood with reference to the following detailed description of an illustrative embodiment of the invention, taken together with the accompanying drawings in which:

FIG. 8. illustrates an exploded view of the screen pin hinge assembly (7) with the second pin (8) removed for illustrative purposes. The locations of such assemblies are indicated demonstrating that they are concealed from view within the screen hinge rail (9).

DESCRIPTION OF THE PREFERRED EMBODIMENT

Figure 1:
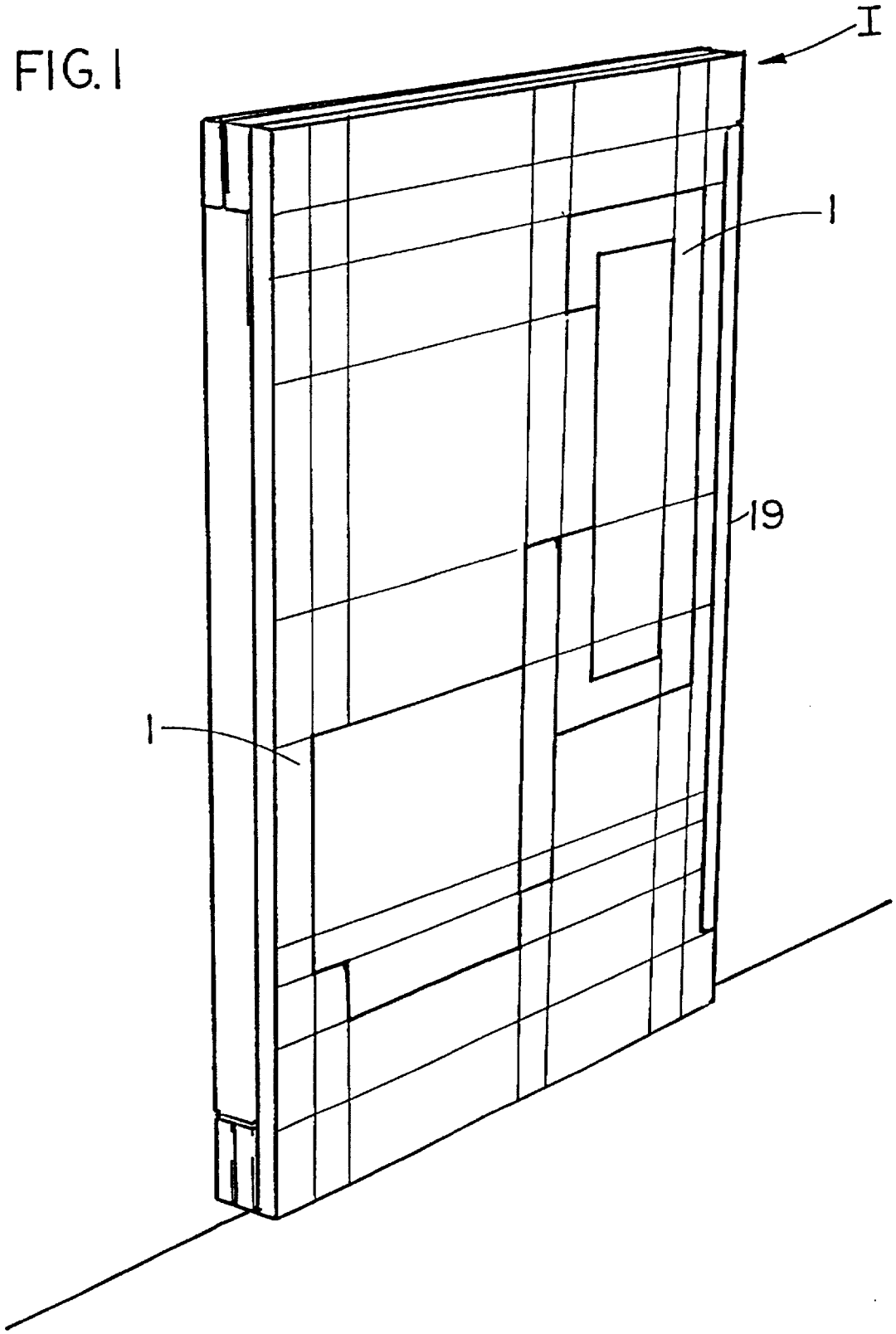
FIG. 1 illustrates a perspective view of a three screen version of the apparatus 1, in a folded and stored configuration. The surface of the screen (19) that is viewed is the back side of what would be the right screen in a fully set up configuration. The lines (1) on the back side of the right screen are illustrating how some of the elements that are stored in the right screen would be partially visible when viewed from the back side of the screen.
Figure 2:
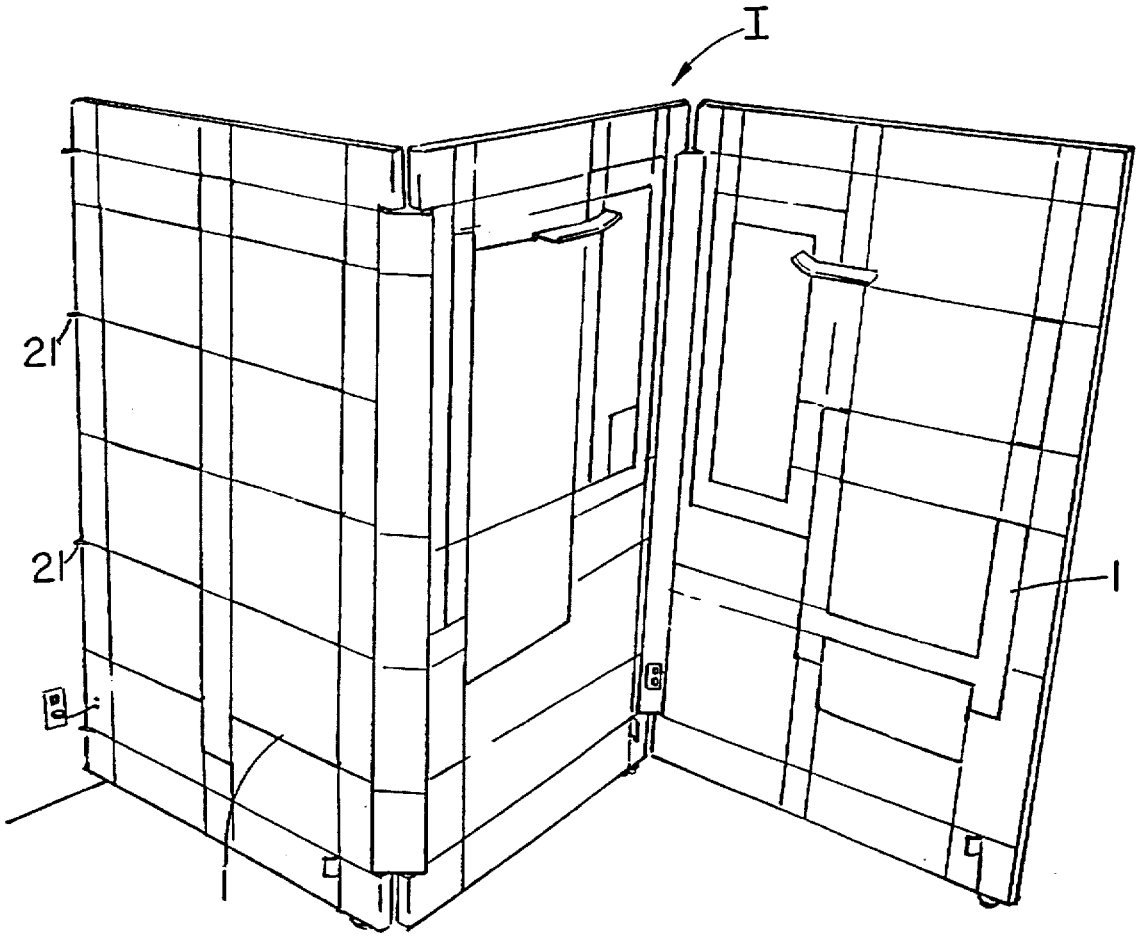
FIG. 2 illustrates a perspective view of the front side of a three screen version of the apparatus in an unfolded configuration. The three screen surfaces viewed are the front sides of the screens that become the work areas. The lines illustrate the various elements at remain in a stored configuration.
Figure 3:
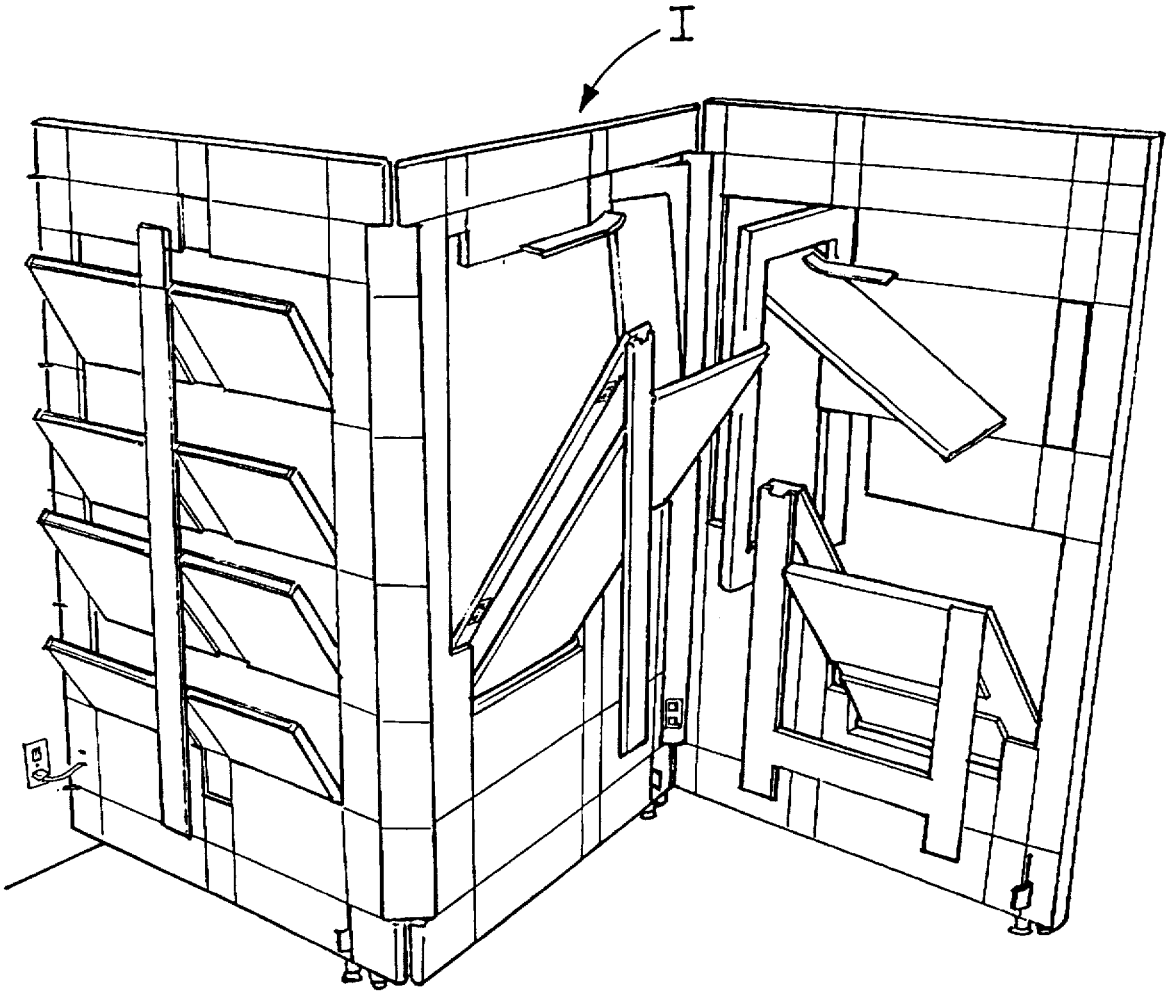
FIG. 3. illustrates a perspective view of the front side of a three screen version of the apparatus in an unfolded configuration. The elements are shown in a partially unstored configuration.
Figure 4:
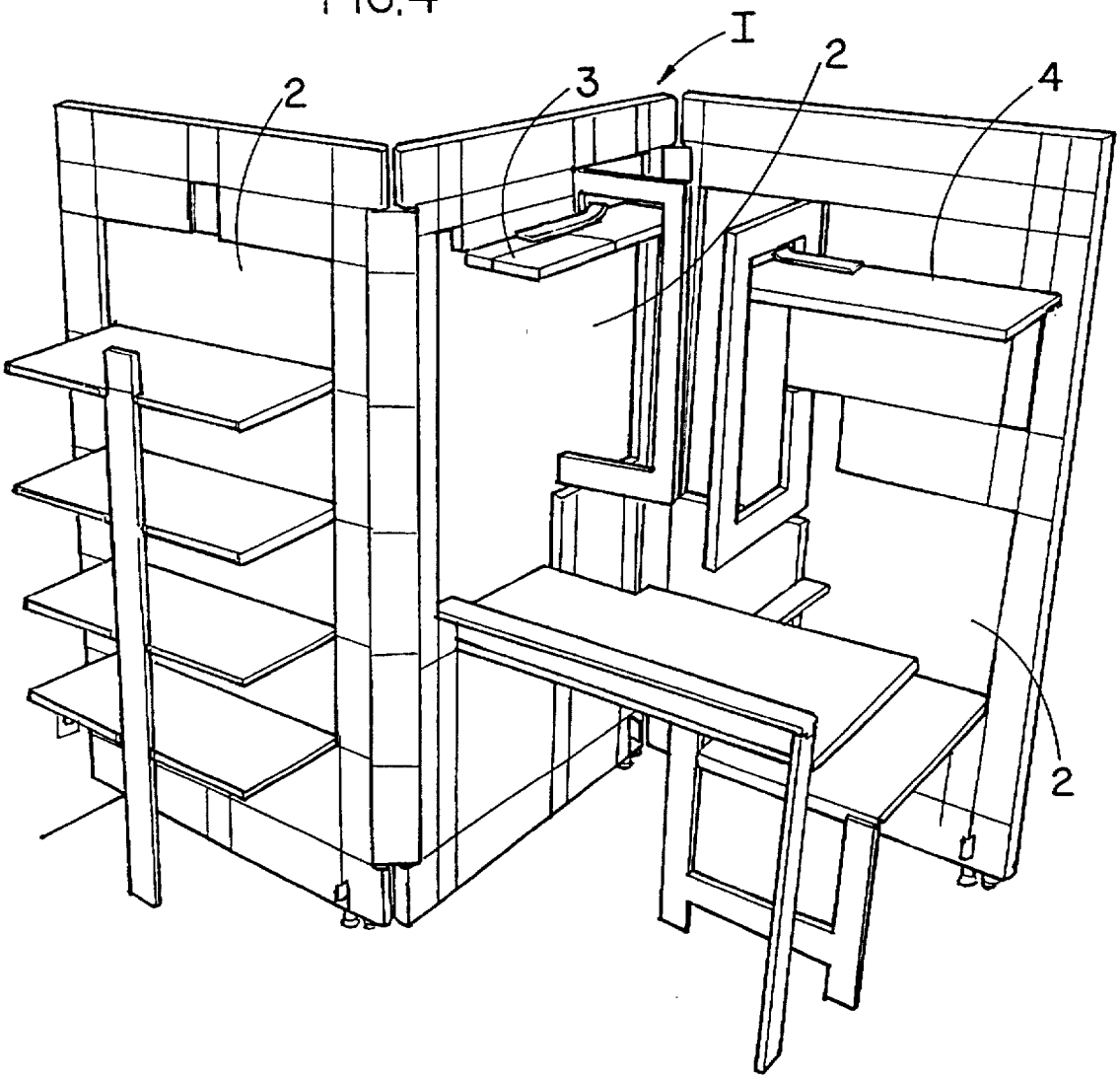
FIG. 4. illustrates a perspective view of the front side of a three screen version of the apparatus in a fully set up configuration. The openings (2) created in the screens as the elements become fully set up could be used to coordinate with a second three screen version of the apparatus positioned against the rear side of the apparatus being viewed.
Figures 5, 5A:
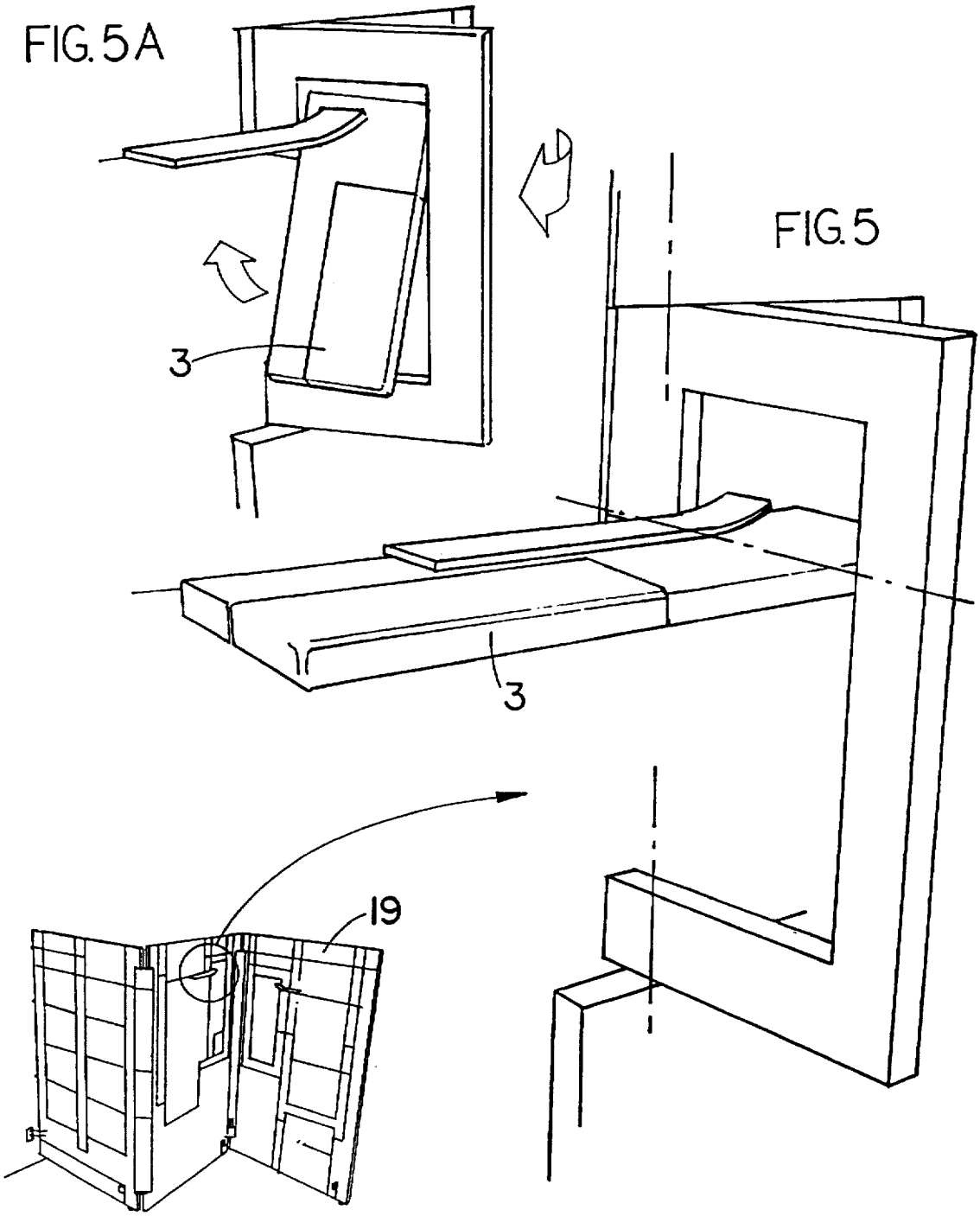
FIG. 5 and 5*a* illustrate exploded sequential views of a lamp element (3) as it moves from a stored configution to a fully set up configuration.
Figure 6:
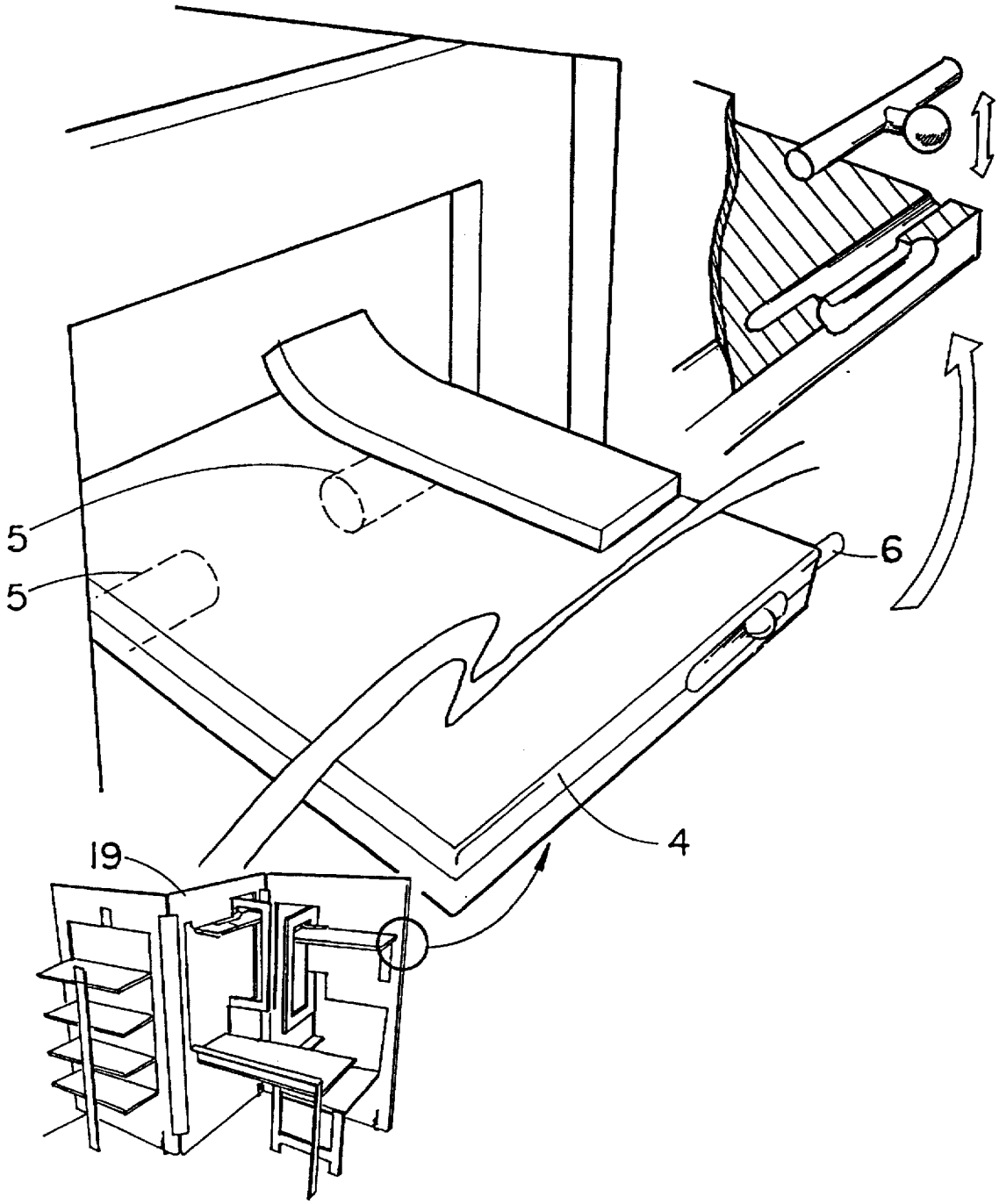
FIG. 6. illustrates an exploded of a shelf element (4) in a fully set up configuration. Also indicated are torsion hinges (5) and recessed lock pin (6).
Figure 7:
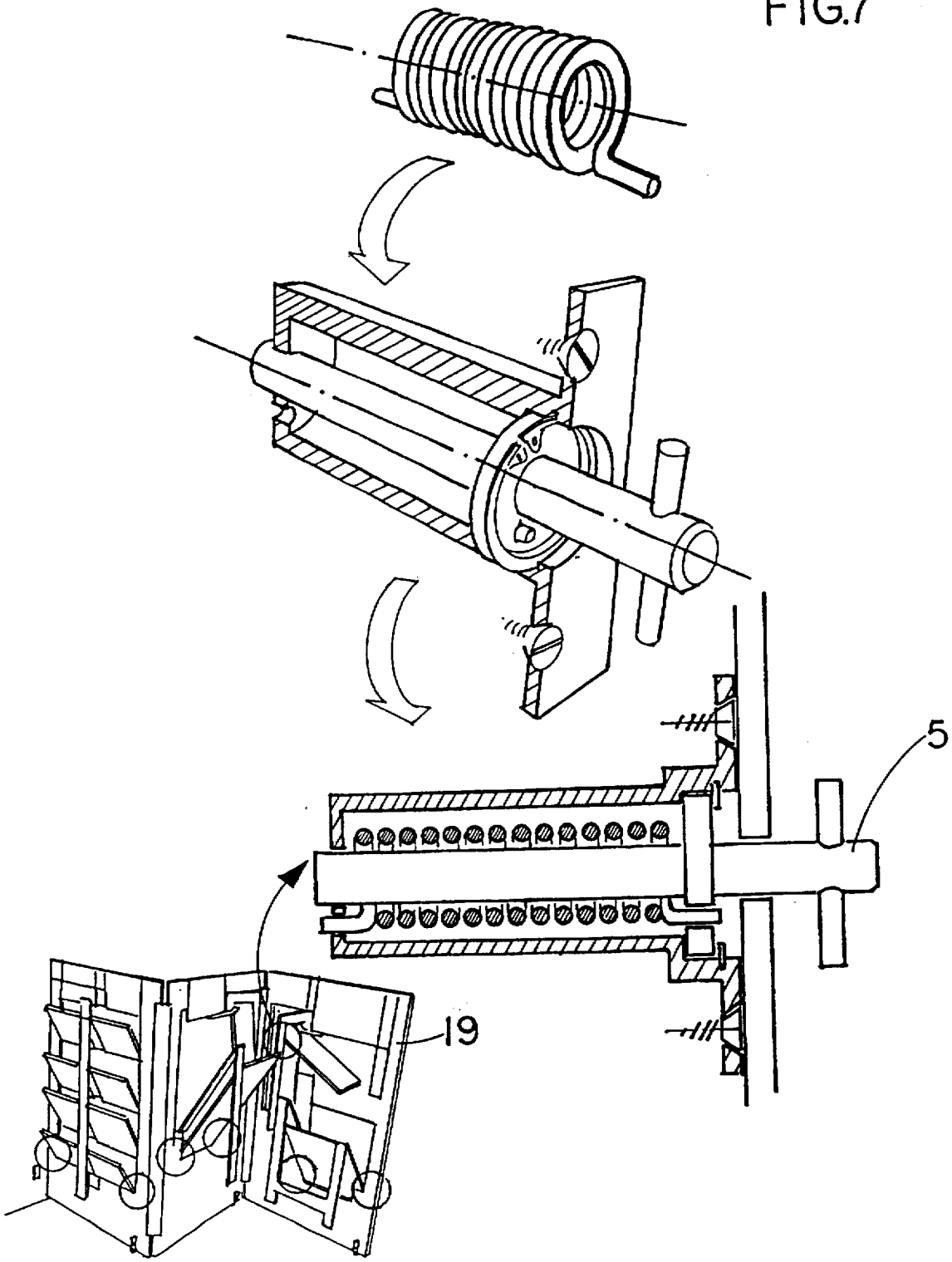
FIG. 7. illustrates an exploded view of a torsion hinge (5) indicating locations where such a hinge would provide ease in moving various elements from a stored configuration to a fully set up configuration.
Figure 9:
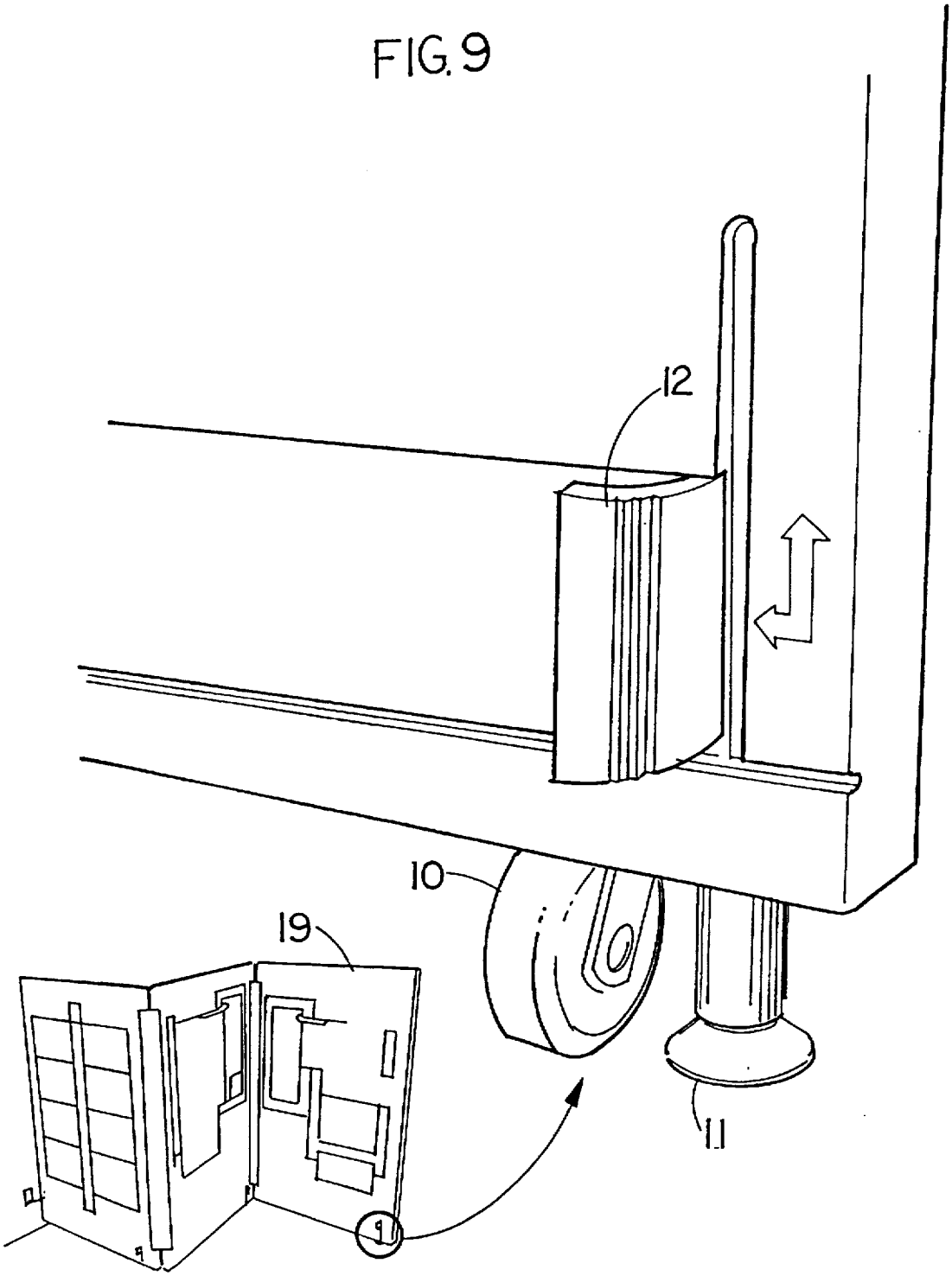
FIG. 9. illustrates a view of a wheel (10). Also illustrated is a spring loaded foot (11) with handle (12) to retract the spring loaded foot (11) to an unlocked position or position the spring loaded foot to a locked position.
Figure 10:
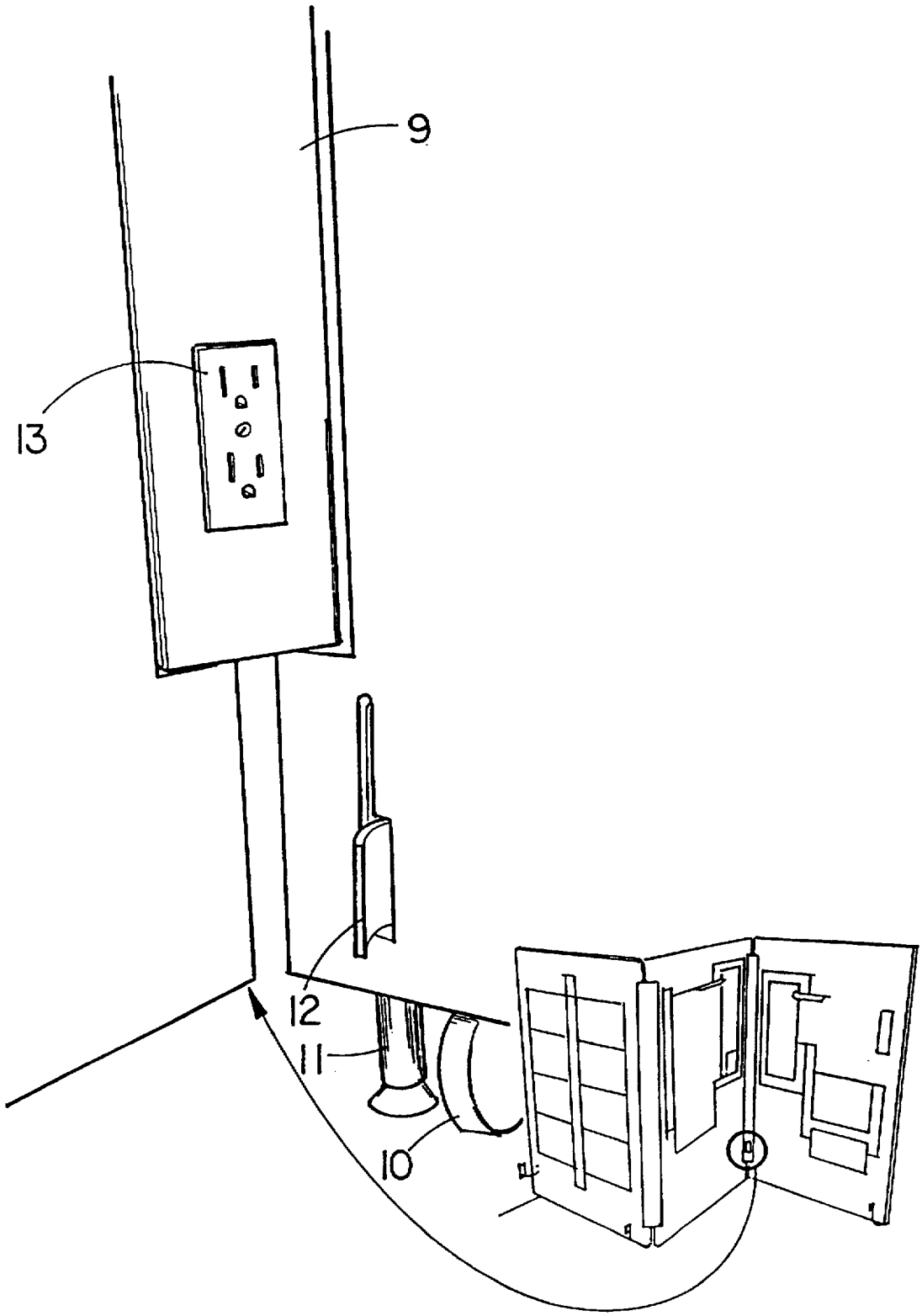
FIG. 10. illustrates a power outlet (13) positioned in the screen hinge rail (9).
Figure 11:
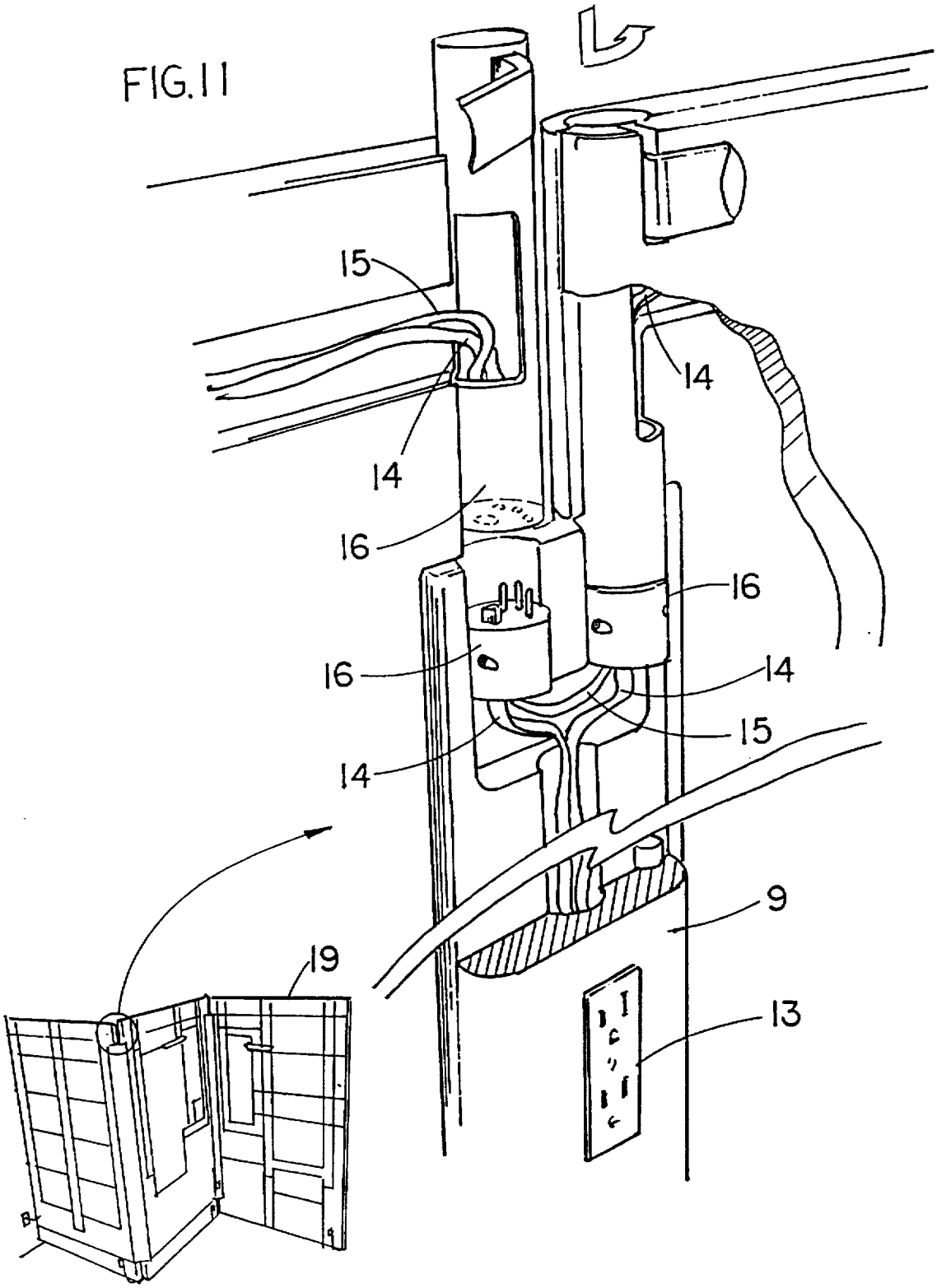
FIG. 11. illustrates an exploded view of a screen hinge rail (9) indicating how the screen hinge rail (9) acts as a conduit for power lines (14). The screen hinge rail (9) also acts as a conduit for other utilities such as telephone lines (15). As indicated the screen hinge rail (9) acts as a connection for these lines and others from a first screen to a second screen Illustrated are electrical plugs (16) that are used for the power lines (14).
Figure 12:
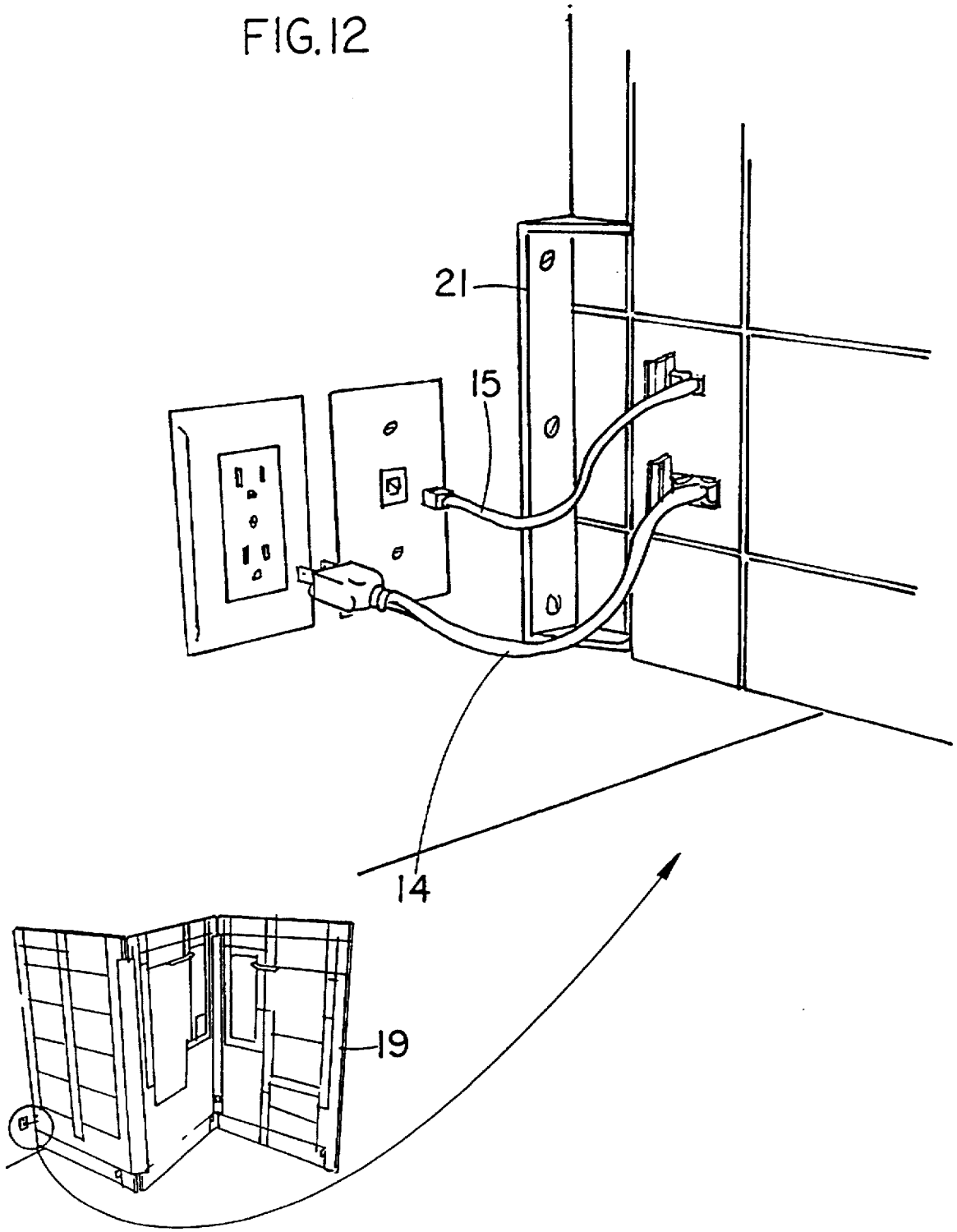
FIG. 12. illustrates a view of retractable power lines (14) and telephone lines (15) from the screen being connected to standard wall outlets.
Figures 13, 13A:
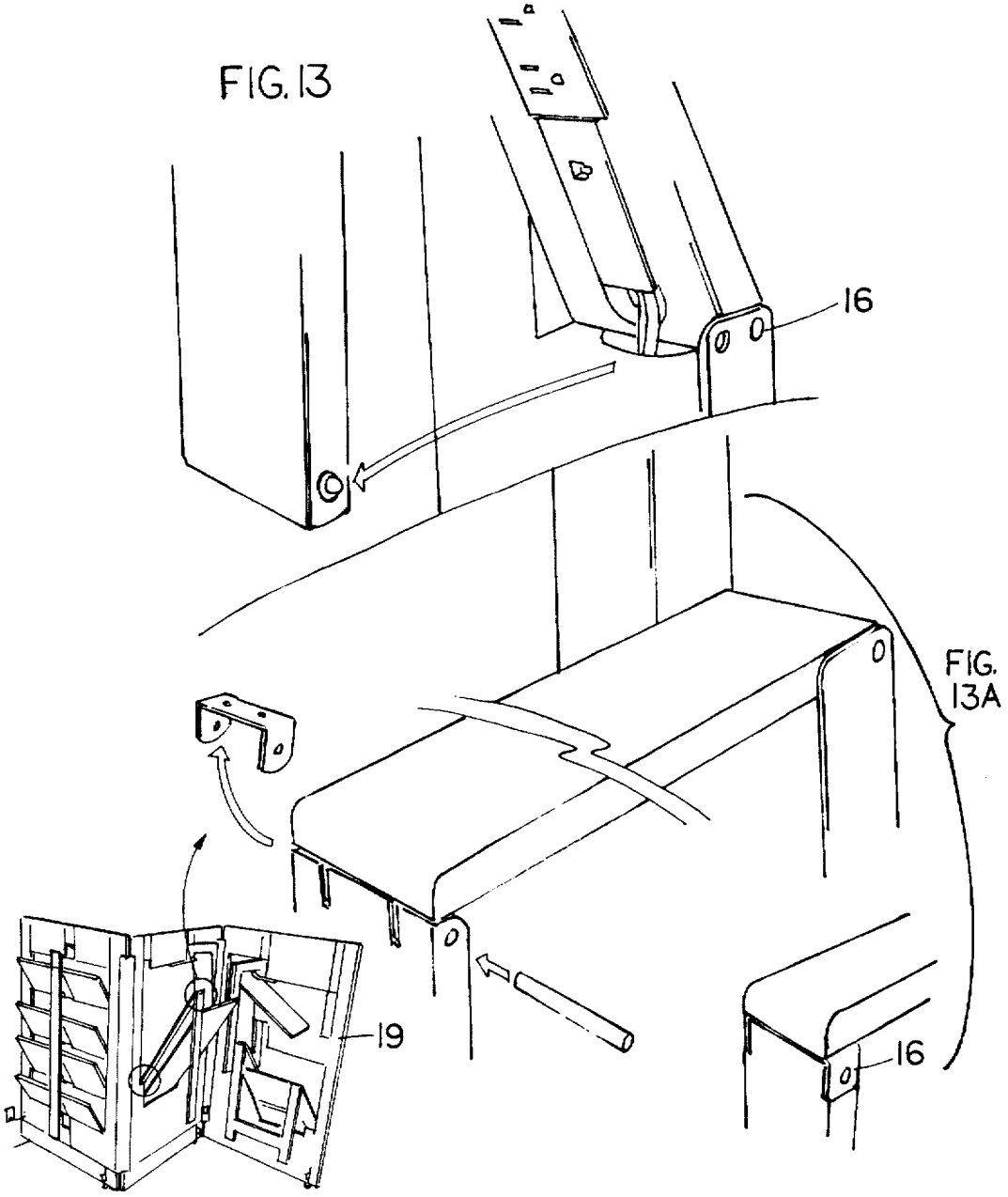
FIG. 13 and 13*a* illustrate exploded views of how pin hinges (16) are used at the various joints of the elements to permit folding of the elements as they are stored, or unfolding of the elements as they are set up.
Figure 14:
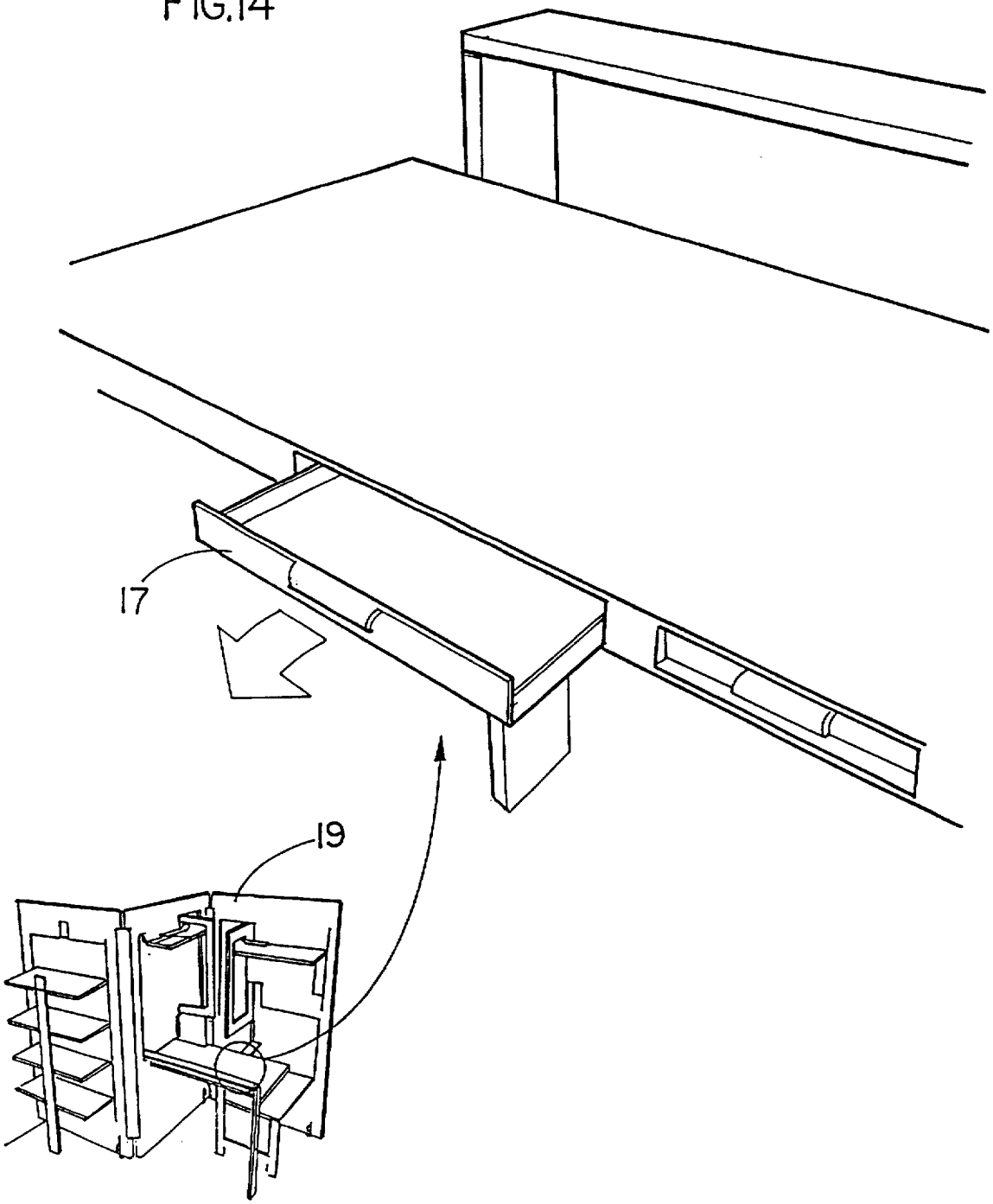
FIG. 14. illustrates how storage trays (17) are incorporated in the various elements.
Figure 15:
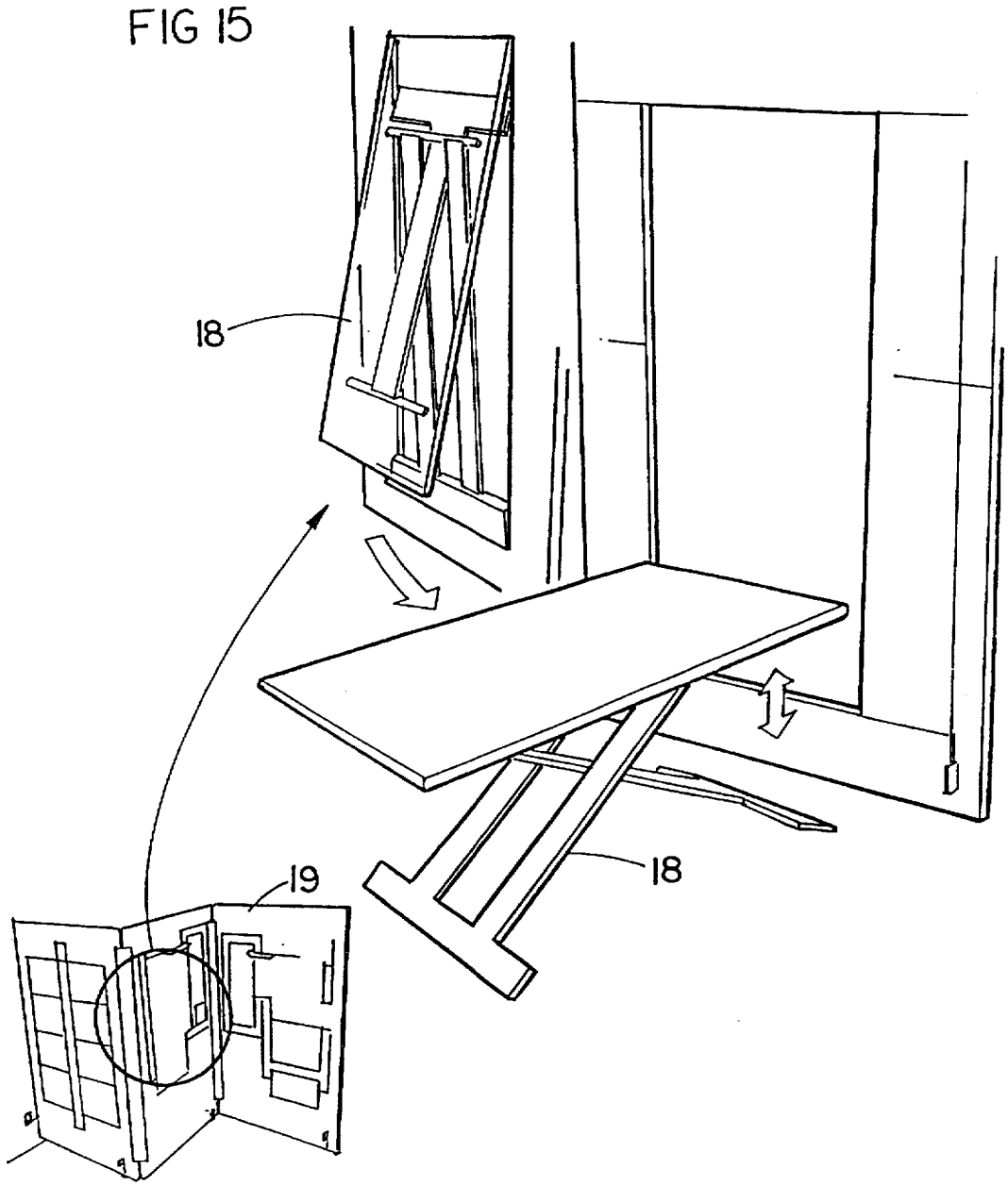
FIG. 15. illustrates a free standing element (18) that is stored within the screen when in a stored configuration.
Figure 15A:
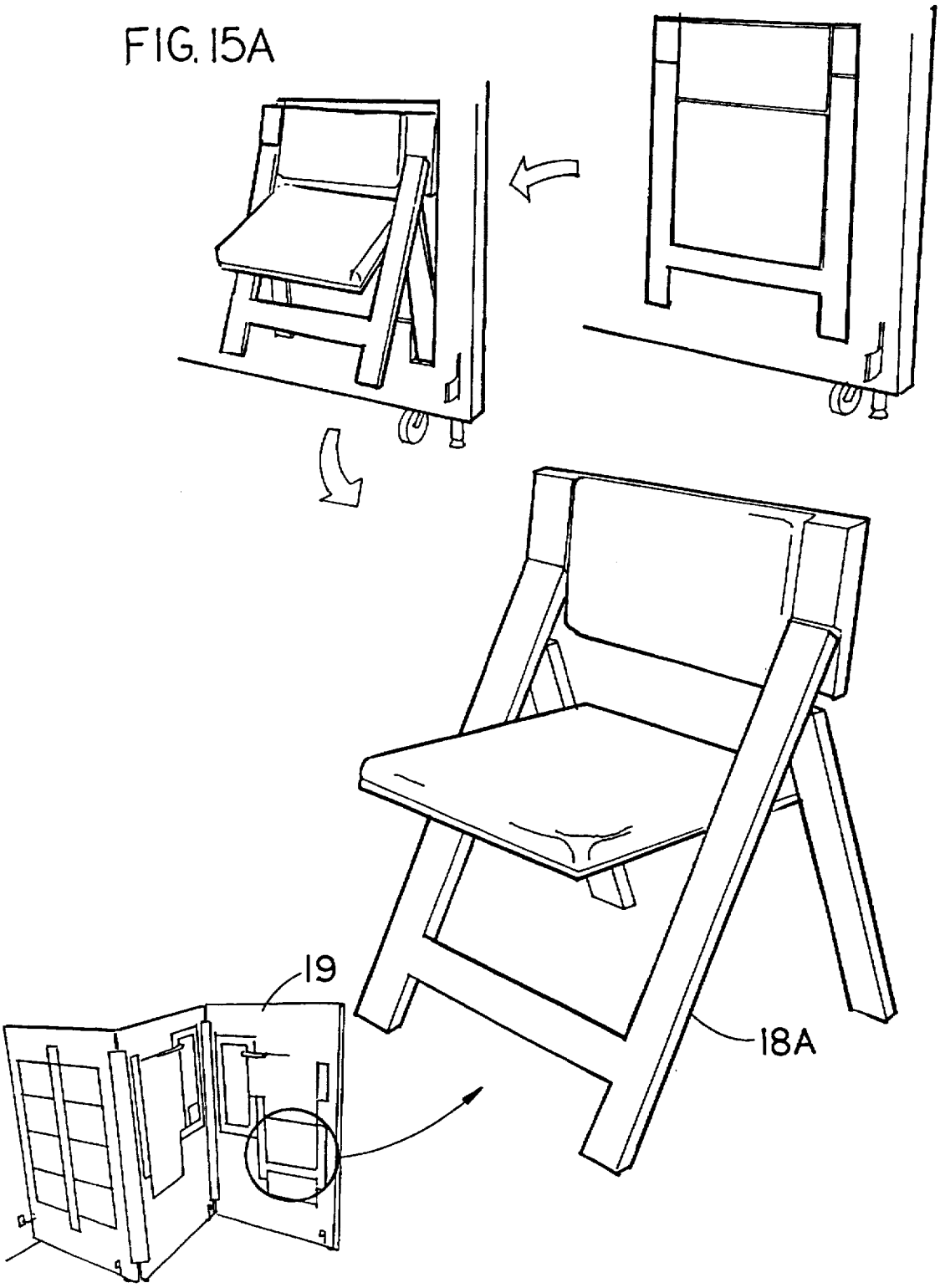
FIG. 15*a* illustrates a free standing element (18*a*) that is stored within the screen when in a stored configuration.
Figure 16:
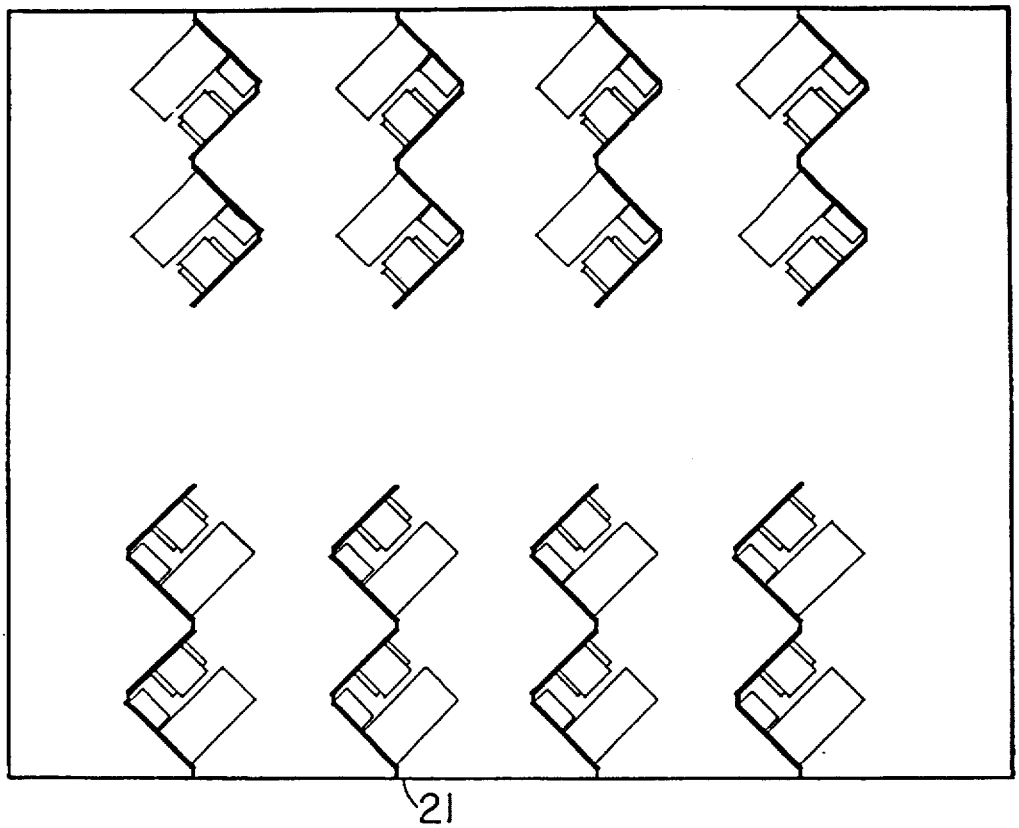
FIG. 16, 17, and 18 are top views of FIGS. 16*a*, 16*b*, 16*c* and FIGS. 17*a*, 17*b*, 17*c* are perspective views that illustrate how the system may be used to provide standard sixteen work station with all multi screen apparatus in a fully set up configuration, a conference environment with the multi screen apparatus in partially folded configuration, and an auditorium environment with the multi screen apparatus in a fully stored configuration.
Figure 16A:
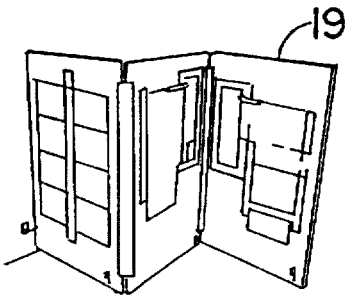
Figure 16B:
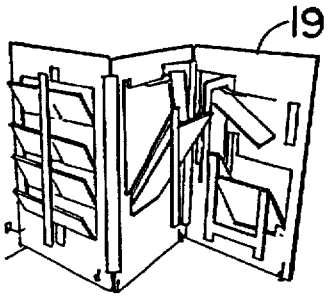
Figure 16C:
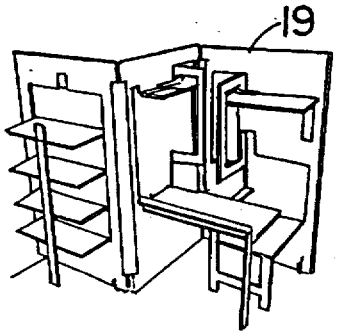
Figure 17:
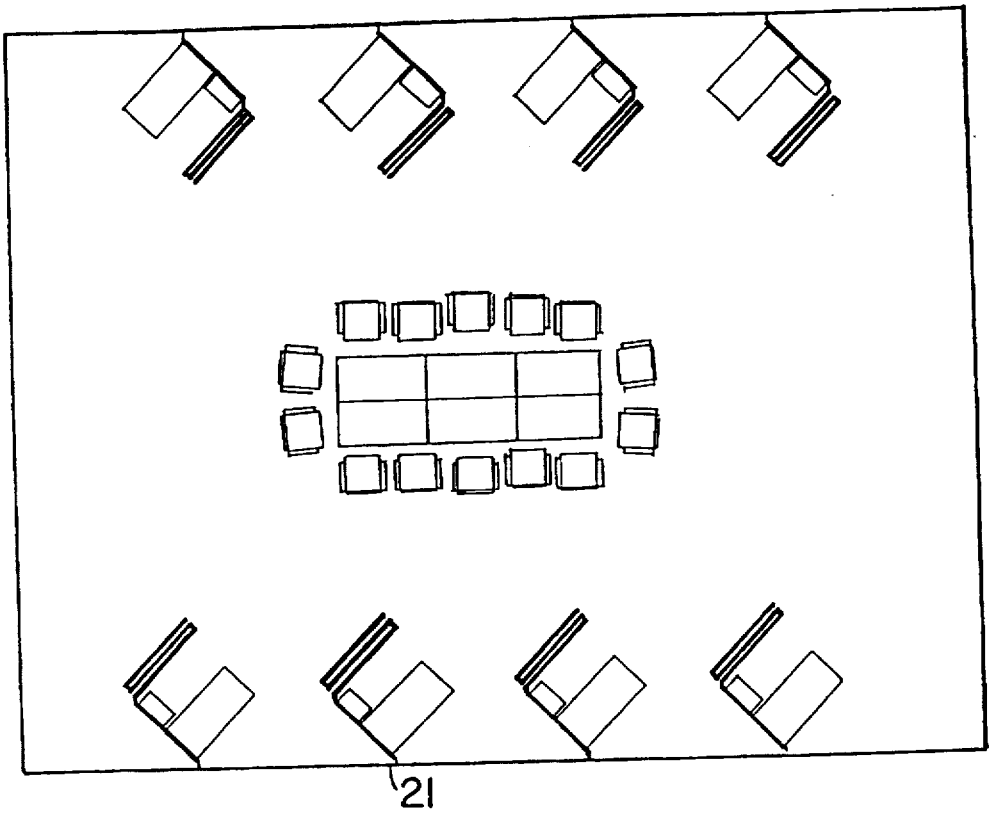
Figure 17A:
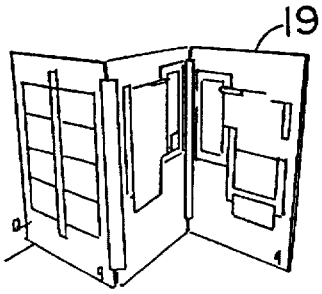
Figure 17B:
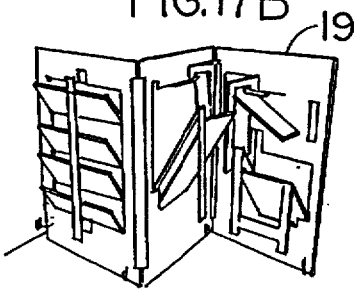
Figure 17C:
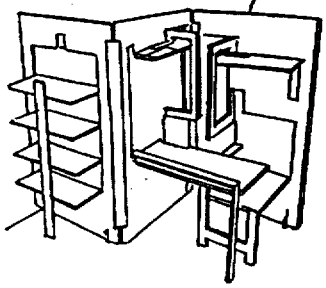
Figure 18:
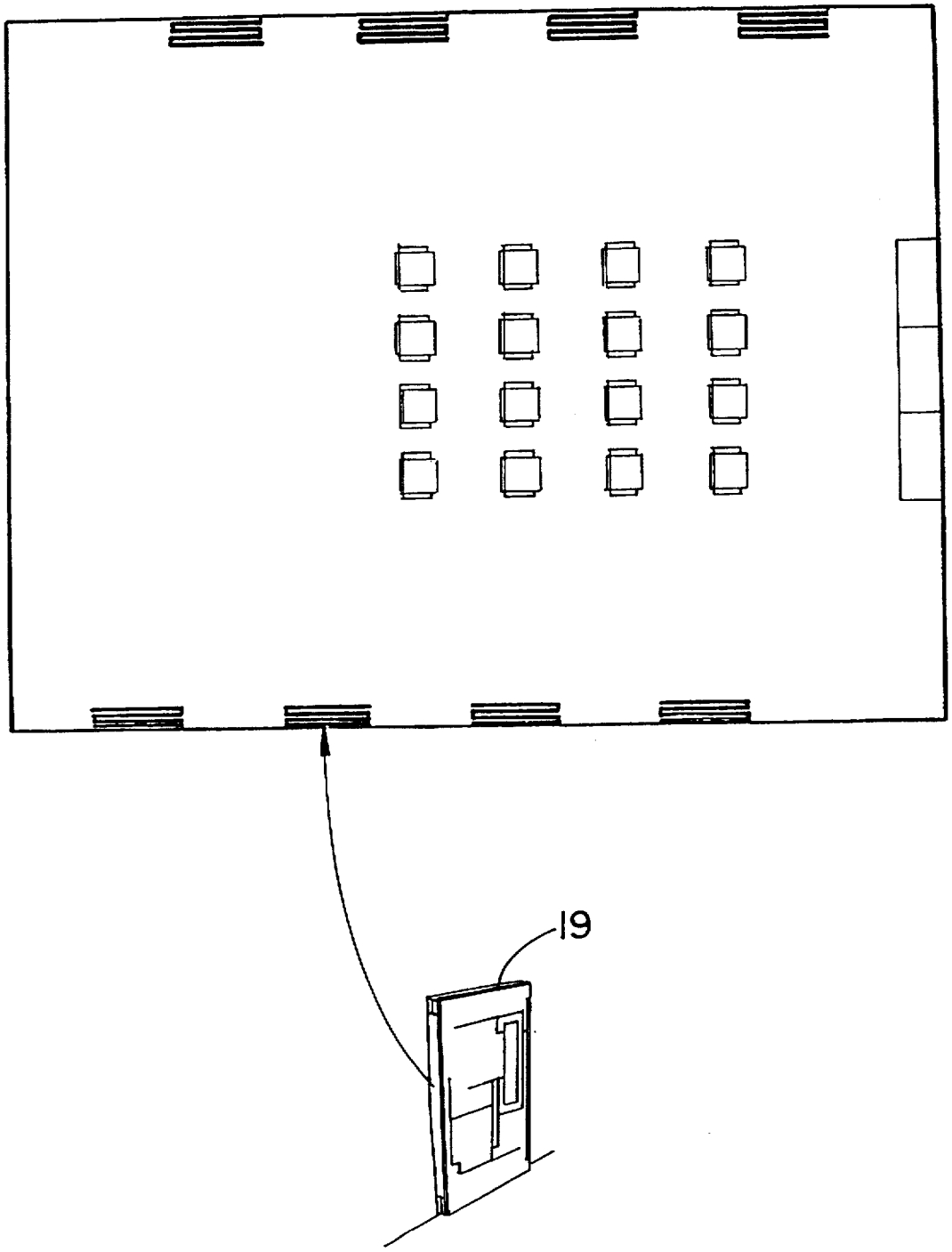

Turning first to FIG. I there is shown the Folding Screen Environment System apparatus positioned in a folded and stored configuration. FIG. 2, FIG. 3, and FIG. 4 demonstrate the apparatus as it is unfolded and configured to a fully set up configuration. The apparatus consists of a plurality of screens (19) that interact by means of pin hinge assemblies (7). The system may utilize as few screens as one or as many as the space provided can accommodate. The Figures illustrate a three screen system. As is indicated the screens provide storage space for the various elements when in a stored configuration. When the elements are in a fully set up position there may be openings in the screens where the element had been stored, the spaces can be used to coordinate with other screen systems. Most of the elements are designed to interact with one or more of the screens when in a fully set up configuration. The screens provide at least one point of support for the elements. The elements may be as varied as the situation requires. For instance the elements may be chairs, tables, lamps, or shelves, as shown in FIG. 4. FIG. 5 and FIG. 5*a* illustrate a lamp element (3). FIG. 6 illustrates a shelf element (4). FIG. 14 illustrates how storage trays (17) may be incorporated in some of the elements. Regardless of the ultimate use to be made of the area the system incorporates the same basic features in order that the elements may be in a stored position when not in use, and in a fully set up position when in use. The screens are sized and shaped in order that the elements fold and become a part of the appropriate screen when stored. Some of the elements (18) and (18*a*) may be free standing when removed from the screen for use, FIG. 15 and FIG. 15*a*. Power lines for electricity and telephone are incorporated in the screens. Screen hinge rails (9) act as conduits for the various lines where the screens meet. The system allows for the screen hinge rails to act as conduits for plumbing, drain lines, electrical, communication and other utilities required at the area. FIG. 11 illustrates how power lines (14) would have electrical plugs (16) allowing for the connection and disconnection for removal or insertion of screens. Torsion hinges (5) are used to allow ease in moving some of the elements, that are heavy or have a likelihood of being awkward, from a stored position to a set up position, or from a set up position to a stored position. Pin hinges (16) are used at the various joints of the lighter elements to permit folding of the elements as they are stored or unfolding of the elements as they are set up. Screens are joined to each other by the use of screen pin hinge assemblies (7). The screen pin hinge assemblies allow for the quick and easy removal of a screen if desired to alter the configuration, or the insertion of an additional screen if desired. The screen pin hinge assemblies may be concealed from view under the screen hinge rail (9). As illustrated in FIG. 9 wheels (10) are used to permit the screens to be easy to move. In addition FIG. 9 illustrates a spring loaded foot (11) with handle (12) to retract the spring loaded foot (11) to an unlocked position to allow for easy movement of the screen, or to a locked position to secure the screen in place when in use.

FIG. 16, FIG. 17 and FIG. 18 and FIGS. 16*a*, 16*b*, 16*c* and FIGS. 17*a*, 17*b*, 17*c* demonstrate how the system may used to provide a flexible work environment where the requirements vary from a standard work area to an auditorium atmosphere.

Figure 19:
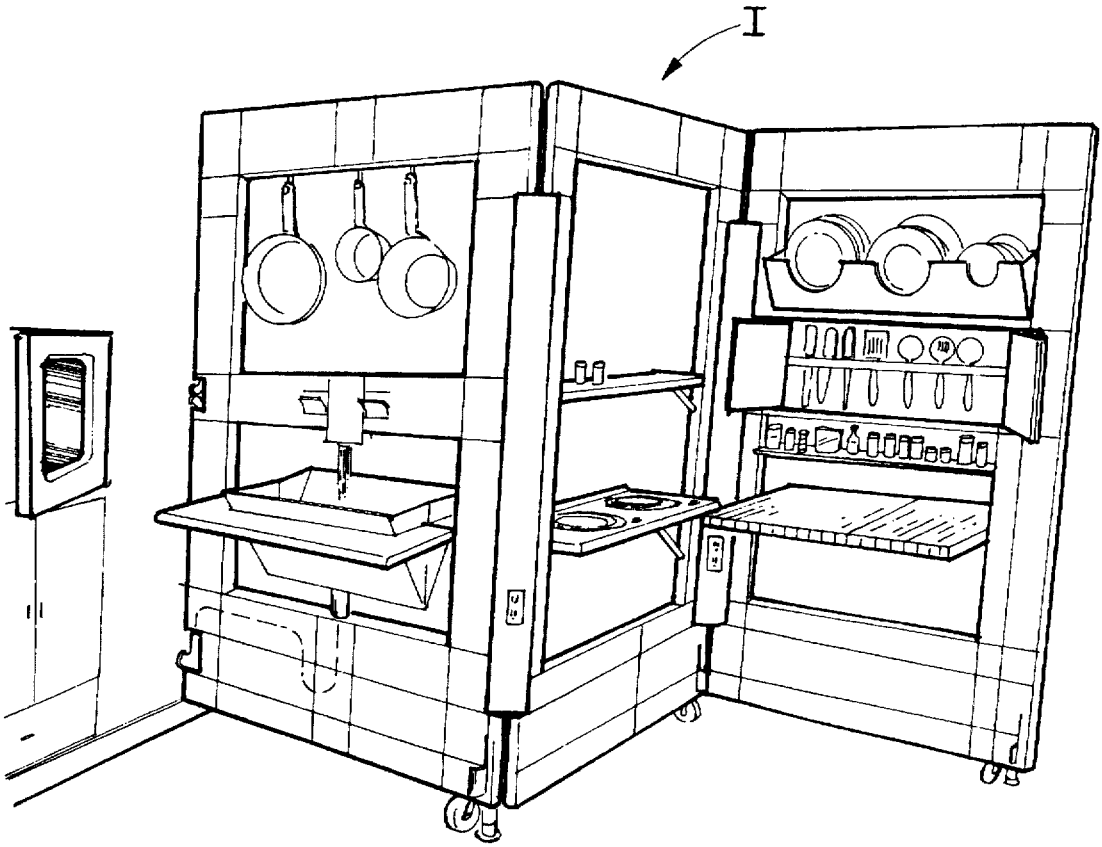
FIG. 19. illustrates the three screen version of the apparatus I equipped with elements for use as a kitchen work area.
Figure 20:
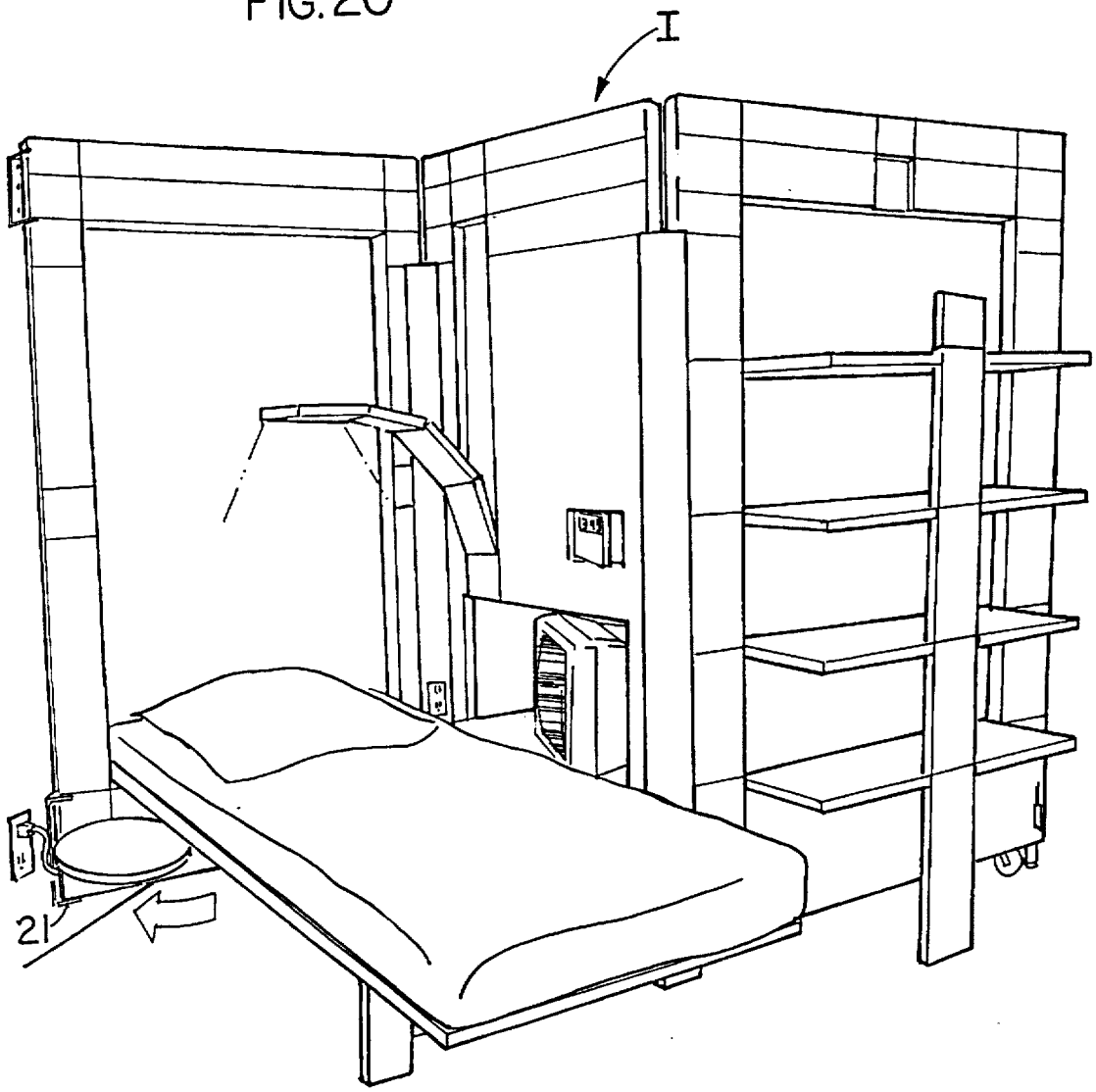
FIG. 20. illustrates the three screen version of the apparatus I equipped with elements for use as a sleep area.

In the event the user desires to make use of the system for a sleeping area FIG. 20 illustrates that the elements would include a bed and related elements. On the other hand if a kitchen area is required FIG. 19 demonstrates that the elements would include a sink, range and refrigerator.

From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

What is claimed is:

1. A folding screen environment system comprising:

at least three vertical screens having vertical edges including hinge means connecting said screens to allow them to be folded against each other. at least two of the screens having functional elements including at least a table and storage units movable between a stored position inset into such screens to become part of said screen forming a substantially planar surface to allow said screens to be folded and a set-up position ready for use;

means connecting the vertical edge of at least one of such screens to a fixed vertical support for stabilizing said at least three vertical screens and for allowing such screens to be unfolded and said functional elements utilized.

2. A folding screen environment system as in claim 1 where said hinge means for connecting said screens includes a pair of pins.

3. A folding screen environment system as in claim 1 where said vertical screens not having an edge connected to a fixed vertical support include means for allowing rolling movement of said screens over a floor each of such screens which have said rolling movement including locking means for preventing said movement.

4. A folding screen environment system as in claim 1 where at least four screens are connected together to form at least two adjacent work stations having said functional elements in a set-up position when pairs of said screens are unfolded to form substantially 90° angle.

5. A folding screen environment system as in claim 1 where said hinge means accommodates electric wiring.

6. A folding screen environment system as in claim 1 where one of said functional elements is a desk which includes a slidable hidden storage tray.

7. A folding screen environment system as in claim 1 where a functional element includes a removable table which is capable of being independently set up.

8. A folding screen environment system as in claim 1 where said functional elements include shelves or file drawers.

* * * * *